US008251761B2

(12) United States Patent
Shamoto et al.

(10) Patent No.: US 8,251,761 B2
(45) Date of Patent: Aug. 28, 2012

(54) CONNECTOR

(75) Inventors: Wataru Shamoto, Yokkaichi (JP); Kenji Makino, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/050,413

(22) Filed: Mar. 17, 2011

(65) Prior Publication Data

US 2011/0230106 A1 Sep. 22, 2011

(30) Foreign Application Priority Data

Mar. 17, 2010 (JP) ..... 2010-061234

(51) Int. Cl.
*H01R 13/44* (2006.01)

(52) U.S. Cl. ..... 439/892

(58) Field of Classification Search ..... 439/157, 439/372, 347, 259, 266, 466, 468, 492
See application file for complete search history.

(56) References Cited

U.S. PATENT DOCUMENTS 5,681,175 A * 10/1997 Busse et al. ..... 439/157
7,150,640 B2 * 12/2006 Fukui et al. ..... 439/157
8,057,245 B2 * 11/2011 Sakamaki et al. ..... 439/157

FOREIGN PATENT DOCUMENTS

JP 2005-116209 4/2005

* cited by examiner

*Primary Examiner* — Alexander Gilman
(74) *Attorney, Agent, or Firm* — Gerald E. Hespos; Michael J. Porco

(57) ABSTRACT

A connector member is formed with first slides (22F, 22R) and first locks (23). A cover (70) is formed with second slides (76F, 76R) and second locks (79). The cover (70) is mounted on the connector member slidably between a standby position and a mount position. The first and second slides (22F, 22R) and (76F, 76R) slide on each other to guide a sliding movement of the cover (70) from the standby position to the mount position. At the mount position, the first and second locks (23, 79) engage to prevent a returning movement of the cover (70) to the standby position. The connector member is formed with guide paths (55) for positioning and guiding the cover (70) to the standby position.

20 Claims, 13 Drawing Sheets

CONNECTOR

BACKGROUND OF THE INVENTION

1. Field of the Invention

The invention relates to a connector.

2. Description of the Related Art

Japanese Unexamined Patent Publication No. 2005-116209 discloses a conventional connector. The connector includes a block-shaped housing with front and rear ends. Wires are drawn out from the rear end and a cap-shaped cover is mounted on the rear end of the housing for covering the wires. A rotatable lever is mounted to straddle the housing. The lever is rotated across a rear side of the cover and the housing to connect with a male housing.

It is difficult to position the cover at a sliding movement starting position on the housing. Particularly, if the lever already is mounted on the housing, the cover interferes with the lever and it is hard to assemble the cover.

The invention was developed in view of the above situation and an object thereof is to enable a cover to be smoothly mounted.

SUMMARY OF THE INVENTION

The invention relates to a connector assembly comprising a connector member from which one or more wires are or are to be drawn out; and a cover to be mounted on the connector member for at least partly covering the wires. The connector member has at least one first slide and at least one first lock and the cover is formed with at least one second slide and at least one second lock. The cover is mounted on the connector member and can slide between a standby position and a mount position. The first and second slides slide on each other to guide a sliding movement of the cover from the standby position toward the mount position. The first and second locks engaged each other at the mount position to prevent a returning movement of the cover toward the standby position. The connector member has at least one guide path for positioning and guiding the cover to the standby position. Thus, the cover can be assembled smoothly.

The second slide preferably is guided slidably substantially along the guide path. Thus, the construction of the cover is simpler than the case where a member to be slidably guided along the guide path is formed on the cover in addition to the second slide.

An assembling direction of the cover guided by the guide path and a sliding direction of the cover from the standby position to the mount position preferably cross each other. Thus, the cover is not brought to the mount position at once and the wires are prevented from being caught between the cover and the connector member.

The connector member preferably includes a housing, from which the wires are drawn out, and a movable member mounted on the housing. The movable member preferably is configured so that displacement of the movable member on the housing connects the housing with a mating housing. The movable member preferably is a lever that is mounted rotatably on the housing.

The guide path preferably is formed in the movable member. Thus, a degree of freedom in the construction of the housing is increased.

Two first slides and two first locks preferably are formed on opposite side surfaces of the housing. Two second slides and two second locks preferably are formed on opposite side walls of the cover. The movable member preferably is a U-shaped lever with a coupling and two arms projecting from opposite ends of the coupling. The arms preferably are arranged to face the opposite side surfaces of the housing.

The guide path preferably is formed by recessing an inner surface of each of the arms, and the second slides are guided slidably along the guide paths. Thus, the cover can be guided in a well-balanced manner.

The second slides preferably are guided slidably along both guide paths at a connection position where the arms are most retracted toward the housing. End edges of the arms may project from an end edge of the housing at the connection position, and entrances of the guide paths are open at the end edges of the arms. Thus, the cover is positioned and guided at an initial stage before the cover engages the housing to improve a guiding function even further.

The second slide preferably is arranged at each of front and rear ends of the cover separated in a sliding direction. The second slide at the front end in the sliding direction is guided slidably along the guide path, and is hidden at an inner side of the movable member. However the second slide at the rear end in the sliding direction is visible at an outer side of the movable member at the connection position. The hidden second slide at the front end of the cover cannot provide a visual confirmation of the position of the cover. However, the second slide at the rear end is visible at the outer side of the movable member at the connection position. Thus, the position of the cover can be detected by visually confirming the position of the second slide at the rear end.

These and other objects, features and advantages of the present invention will become more apparent upon reading of the following detailed description of preferred embodiments and accompanying drawings.

DETAILED DESCRIPTION OF THE PREFERRED EMBODIMENTS

One particular embodiment of the present invention is described with reference to FIGS. 1 to 13. A connector according to this embodiment includes a housing 10, a lever 40 as a movable member and a cover 70. The housing 10 and the lever 40 form part of a connector member. The housing is connectable to a mating housing 100.

Figure 5:
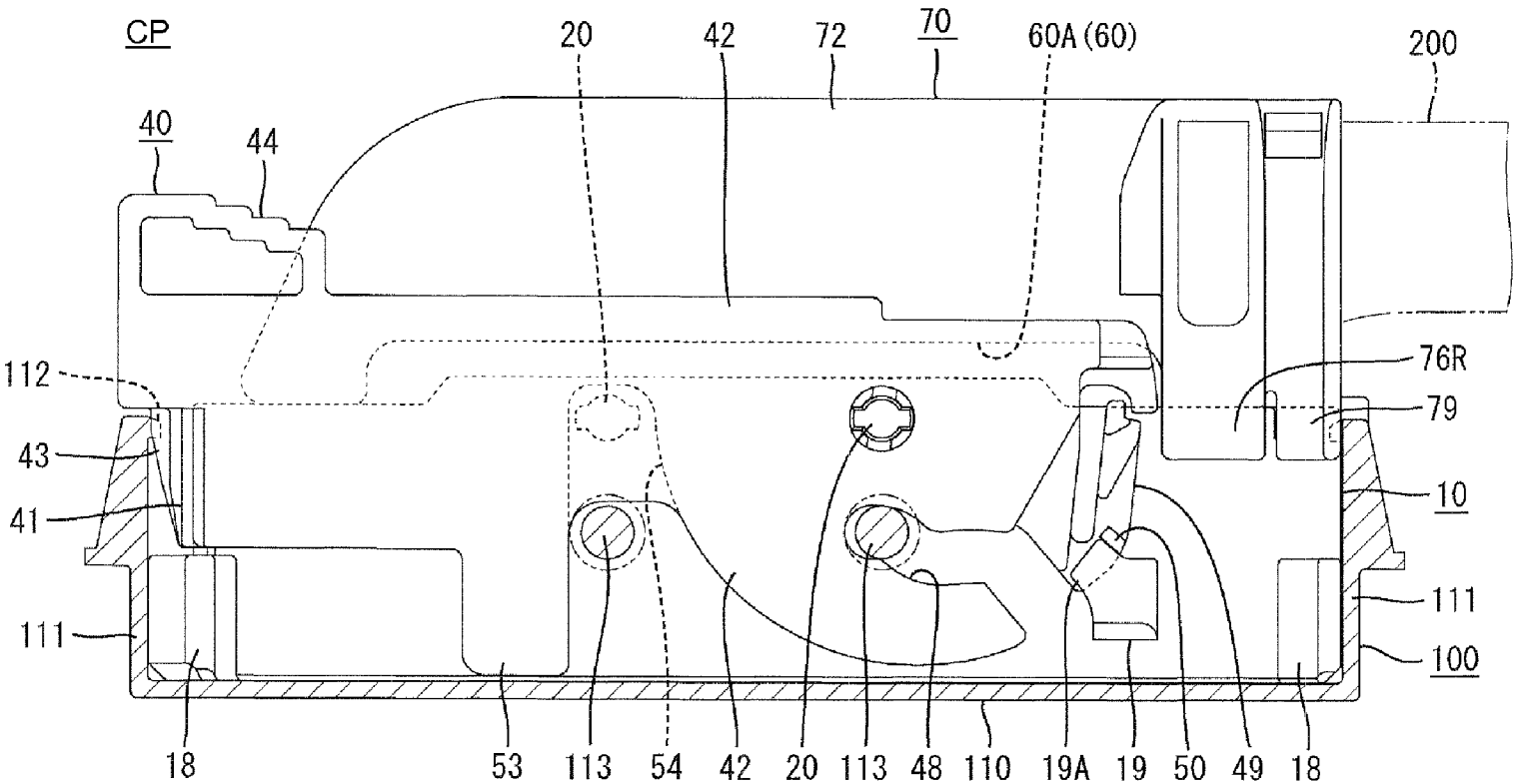
FIG. 5 is a plan view showing a state where the lever is at a connection position.
Figure 6:
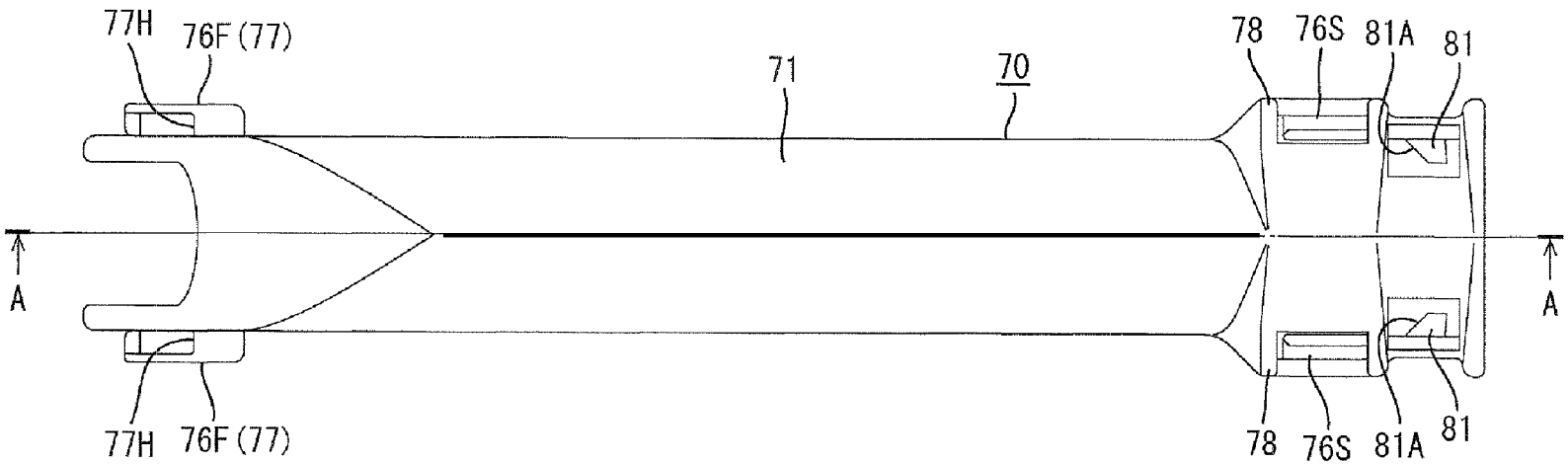
FIG. 6 is a plan view of the cover.
Figure 7:
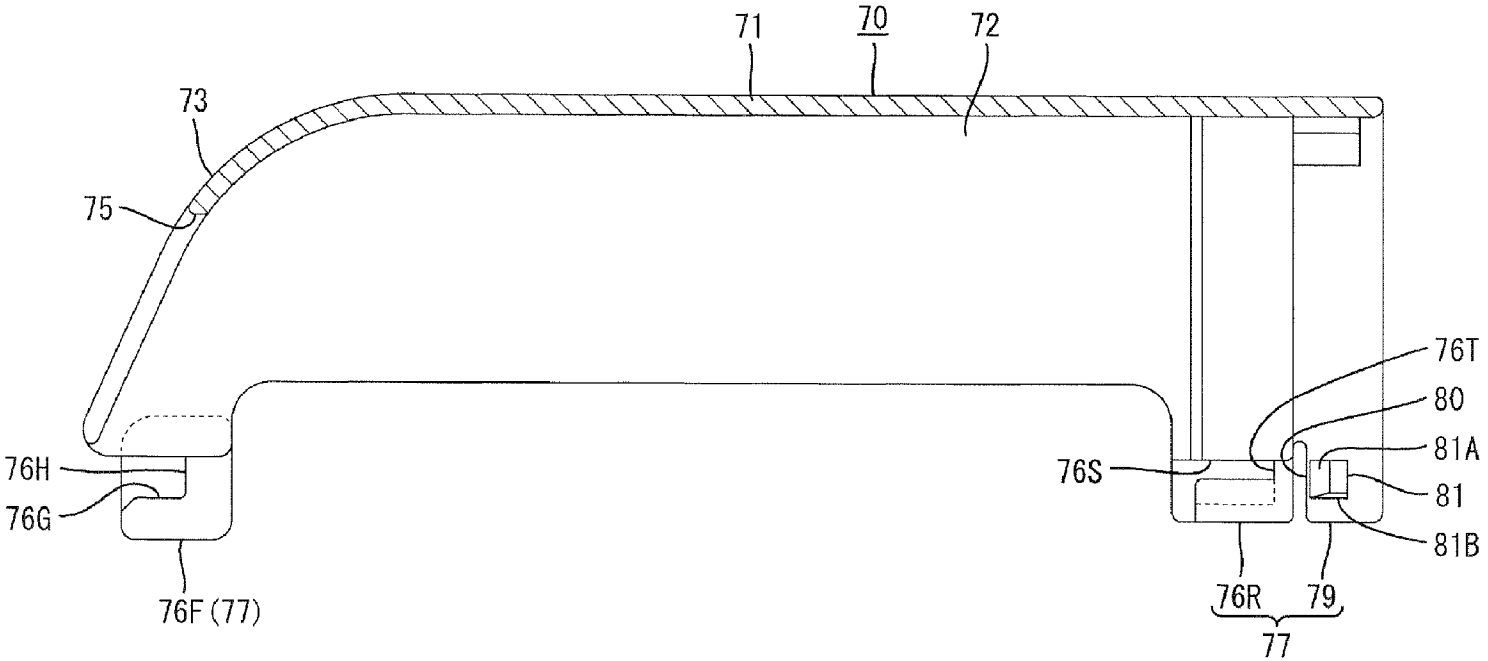
FIG. 7 is a section along A-A of FIG. 6.
Figure 8:
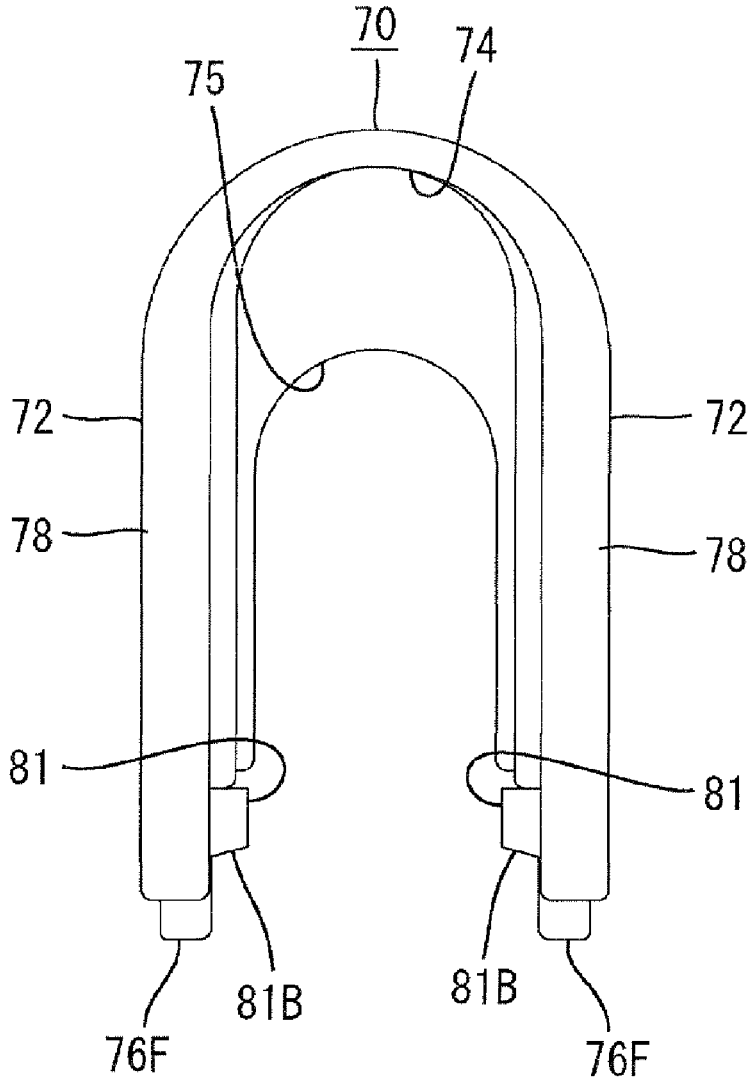
FIG. 8 is a right side view of the cover.
Figure 9:
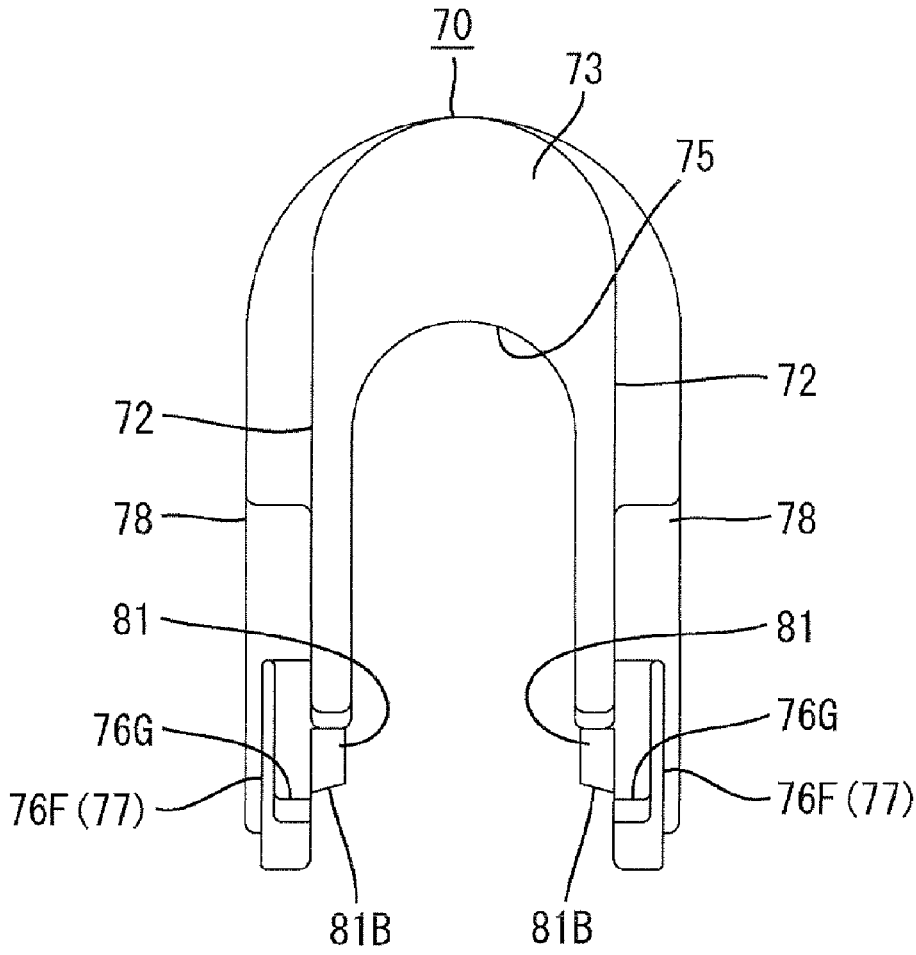
FIG. 9 is a left side view of the cover.

The mating housing 100 is made e.g. of synthetic resin and includes a receptacle 110 in the form of a narrow substantially rectangular tube that is long in a width direction, as shown in FIG. 5. Claw-shaped engaging portions 112 project from the inner surfaces of the front ends of the side walls 111 of the receptacle 110. Left and right substantially cylindrical cam followers 113 project on the inner surface of the each of the upper and lower walls of the receptacle 11 at opposite sides of a widthwise center. Unillustrated male tabs are arranged to project into the receptacle 110.

Figure 10:
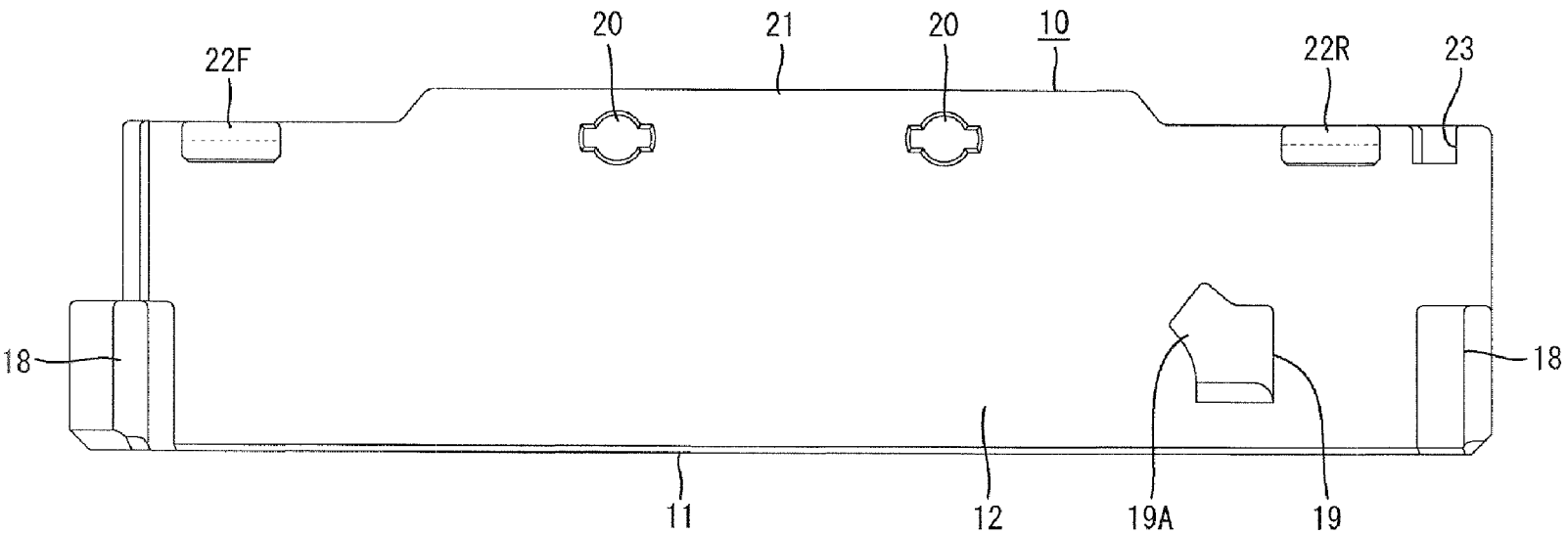
FIG. 10 is a plan view of a housing.
Figure 11:
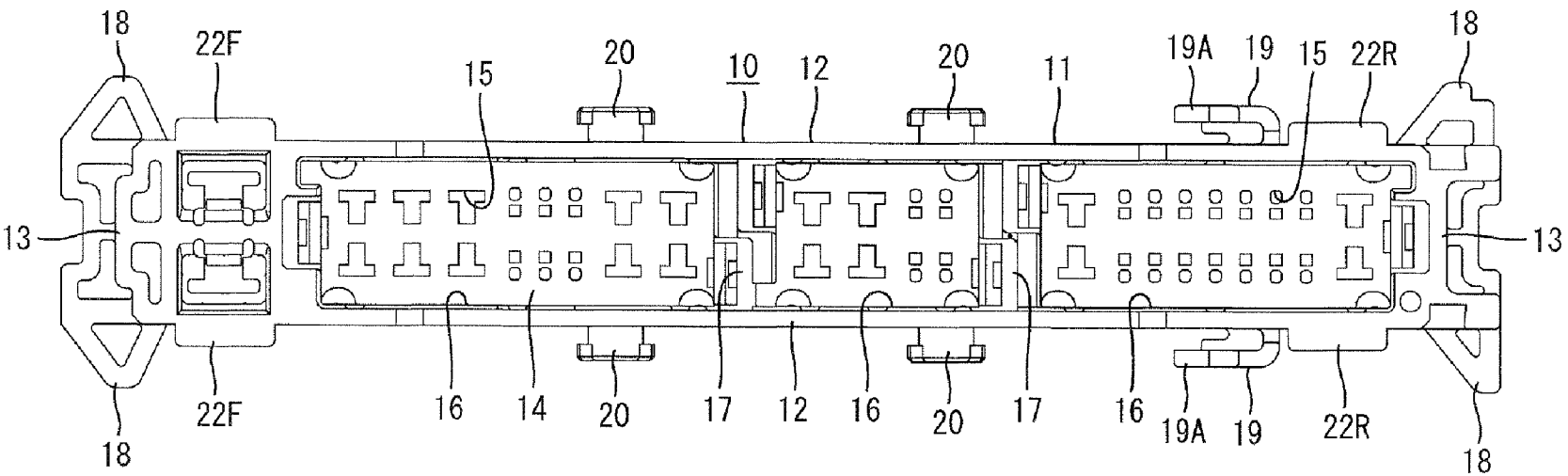
FIG. 11 is a rear view of the housing.

The housing 10 is made e.g. of synthetic resin and includes a housing main body 11 in the form of a narrow substantially rectangular box long in the width direction, as shown in FIGS. 10 and 11. The housing main body 11 has front and rear long walls 12 arranged substantially along the width direction, left and right short walls 13 arranged substantially along a height direction, a mating wall 14 at a mating end and has an open wire draw out end. The mating wall 14 has terminal insertion holes 15 for receiving the male tabs when connecting the two housings 10, 100. Sub-housing accommodating recesses 16 are formed substantially side by side in the width direction in the housing main body 11, and partition walls 17 extend in the height direction between the respective sub-housing accommodating recesses 16. Rectangular block-shaped sub housings (not shown) are to be accommodated into the respective sub-housing accommodating recesses 16 and female terminal fittings (not shown) are accommodated in the sub housings. The female terminal fittings are connected respectively to ends of wires 200, and the wires 200 are drawn out to the outside from the wire draw out end of the housing 10.

Protrusions 18 are formed at opposite widthwise ends of front sides of the long front and rear walls 12. The protrusions 18 are ribs extending in mating directions, and are fit into unillustrated recessed grooves of the mating housing 100 when the two housings 10, 100 are oriented properly, but contact the mating end edge of the receptacle 110 without being fit into the recessed grooves if the housings 10, 100 are not oriented properly. A hook 19 projects at a position near one widthwise end of each long front and rear wall 12. The hook 19 includes a plate-like hooking piece 19A substantially parallel to the outer surface of the long front and rear walls 12.

Left and right substantially cylindrical shafts 20 project from the front and rear walls 12 near the wire draw out end and at opposite sides of the widthwise center. A bulge 21 projects back from a widthwise intermediate part of each of the front and rear walls 12 at the wire draw out end, and parts of the shafts 20 are supported on the bulge 21. Left and right housing slides 22F, 22R are formed at the opposite widthwise sides of each of the front and rear walls 12 with the shafts 20 located therebetween. The respective housing slides 22F, 22R are substantially L-shaped in section and are thin and long in the width direction substantially along the rear end edges of both front and rear walls 12.

The right housing slides 22R are at a rear end in a sliding direction of the cover 70 and the left housing slides 22F are at a front end in the sliding direction of the cover 70. Housing locks 23 are formed by cutouts at positions on the front and rear walls 12 closer to the right widthwise end than the right housing slides 22R (more backward in the sliding direction SD). The housing locks 23 are bottomed recessed grooves having a rectangular plan view and open at the wire draw out end of the front and rear walls 12.

Figure 12:
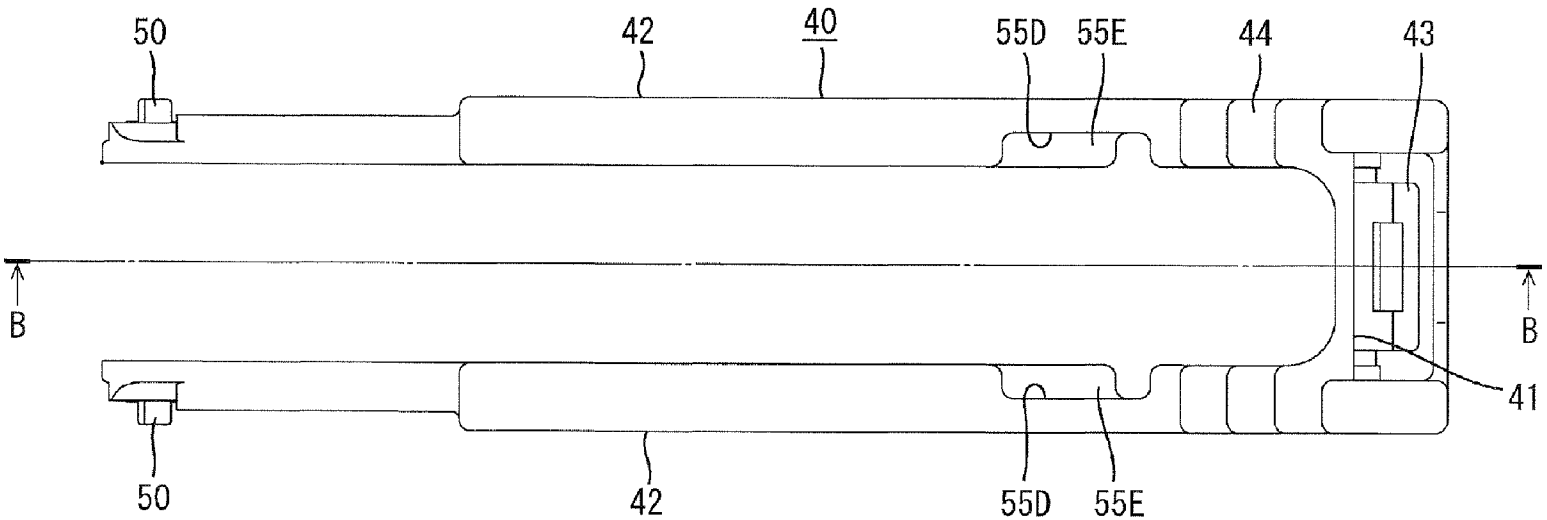
FIG. 12 is a side view of the lever.
Figure 13:
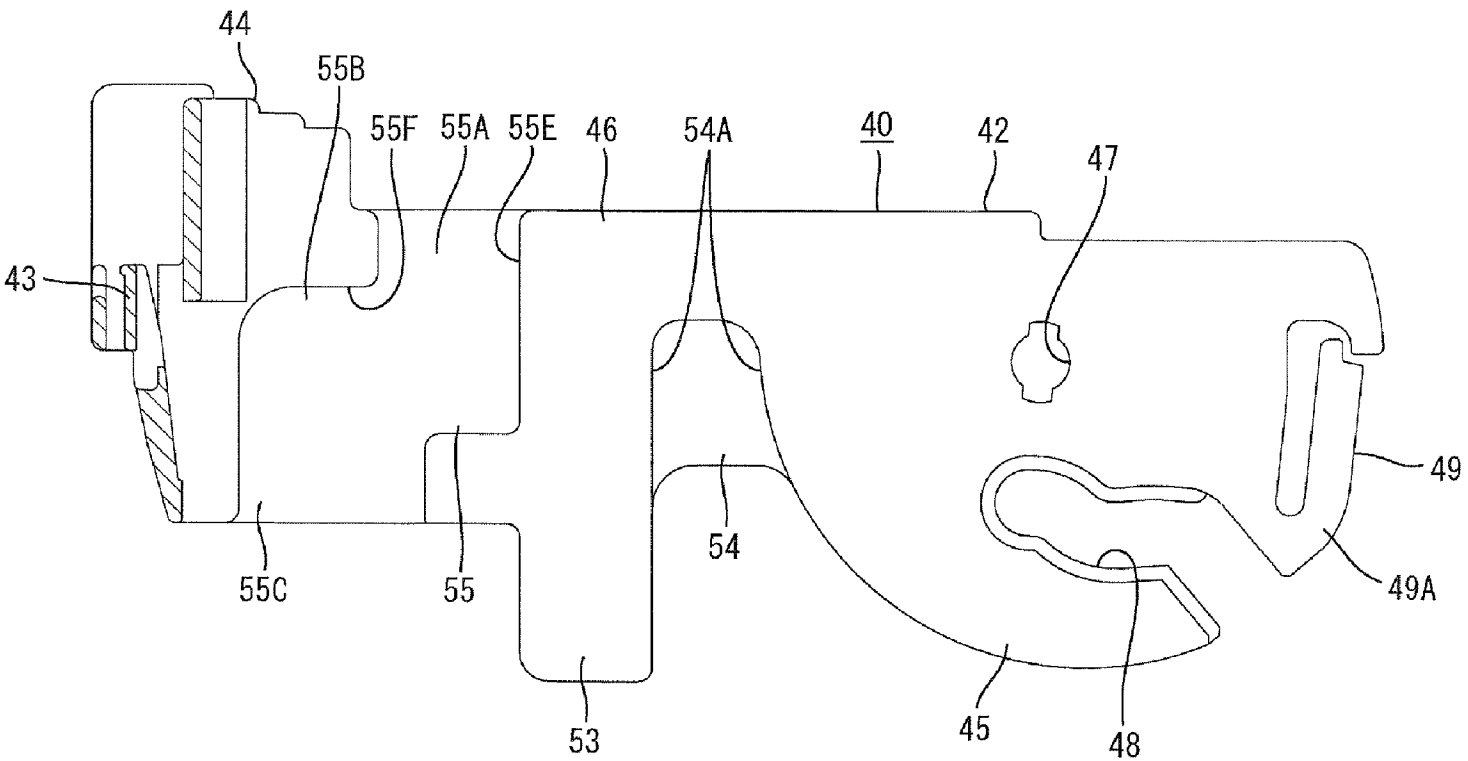
FIG. 13 is a section along B-B of FIG. 12.

The lever 40 is made e.g. of synthetic resin and has a coupling 411 extending in the height direction. Arms 42 project in the width direction from opposite ends of the coupling 41. Thus, the lever 40 is substantially U-shaped, as shown in FIGS. 12 and 13. The coupling 41 is formed with a resiliently deformable lock 43. A substantially step-like operable portion 44 is formed at a rear end of the coupling 41.

Figure 1:
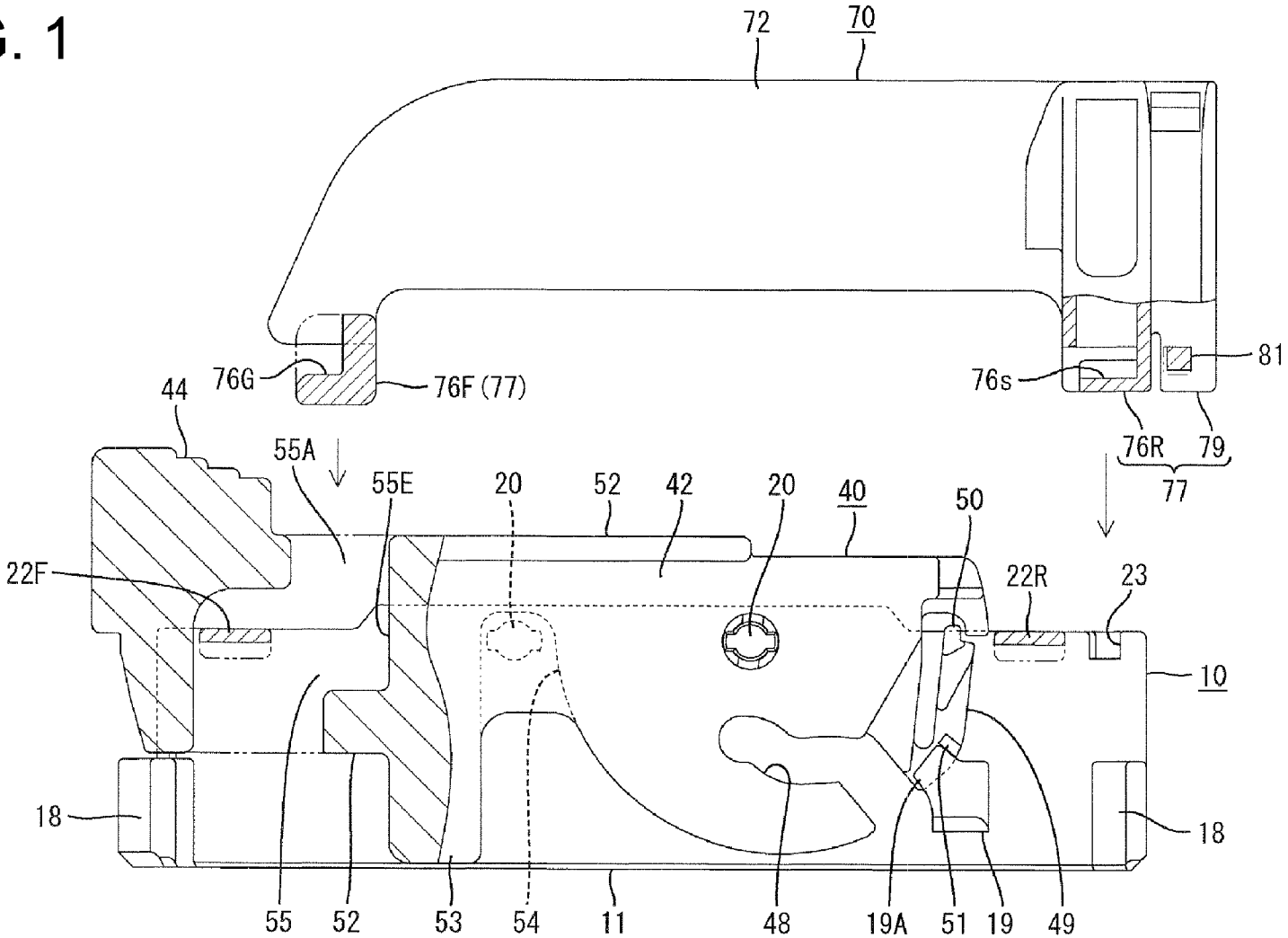
FIG. 1 is a plan view partly in section showing a state before a cover is mounted in a connector according to one embodiment of the invention.

Each arm 42 includes an action portion 45 distant from the coupling 41 and a link 46 linking the coupling 41 and the action portion 45. The action portion 45 has an arcuate outer peripheral edge and a bearing hole 47 penetrates through the action portion 45 at an inner position. The action portion 45 also has a bottomless cam groove 48 open at the outer peripheral edge of the action portion 45, and a resilient piece 49 cantilevered along the outer peripheral edge. The resilient piece 49 has a base end 49A near the entrance of the cam groove 48 and is resiliently deformable with the base end 49A as a support. As shown in FIG. 1, the resilient piece 49 has a first projection 50 at its leading end and a second projection 51 at its base end. Straight edges 52 extending in the width direction are formed on the opposite front and rear ends of the link 46 of each arm 42. The rear straight edge 52 is continuous with the action portion 45.

The lever 40 is mounted to straddle the housing 10 from wire draw out end so that the shafts 20 fit in the bearing holes 47. The lever 40 then is rotatable about the shafts 20 between an initial position IP and a connection position CP. At the initial position IP, the coupling 41 is distant from and behind the housing 10 and the rear straight edges of the arms 42 are oblique to the wire draw out end of the housing 10 (see FIG. 4). At the connection position CP, the coupling 41 is near an end of the housing 10 and the rear straight edges 52 of the arms 42 are substantially parallel to the wire draw out end of the housing 10 (see FIG. 5). Further, at the connection position CP, the arms 42 face the outer surfaces of the front and rear walls 12 of the housing 10. In this embodiment, only the shafts 20 at the right side are used and the lever 40 is not supported on the shafts 20 at the left side. This is because the housing 10 has a structure common to another unillustrated housing sharing the mating housing 100 and can be formed by the same mold. In the other housing, the lever 40 is supported on shafts at the left side and rotated in an opposite direction.

A projection 53 projects forward from the front edge of each link 46. The projection 53 is a substantially rectangular plate that is thinner than the action portion 45. A bottomed recess 54 is formed in the inner surface of the link 46 of each arm 42 and opens at the front edge. Opposite widthwise sides of the recess 54 are defined by an edge 54A extending continuously from an edge of the projection 53 and continuously from the outer periphery of the action portion 45.

A guide path 55 for guiding displacement of the cover 70 relative to the housing 10 is formed in the inner surface of the link 46 of each arm 42. The guide path 55 is a bottomed recessed groove extending in the height direction and opens at the opposite front and rear edges of the link 46. Specifically, the guide path 55 has an assembly guide 55A near the coupling 41 and extending straight forward from the rear edge of the link 46, a slide permitting portion 55B extending from the front end of the assembly guide 55A toward coupling 41 and a mold removing portion 55C extending forward from an end of the slide permitting portion 55B to the front edge of the link 46. An entrance 55D for receiving the cover 70 is the part of the assembly guide 55A at the rear edge of the link 46. The assembly guide 55A is narrower than the slide permitting portion 55B and the mold removing portion 55C. The assembly guide 55A and the mold removing portion 55C partly overlap in the width direction, and the entrance 55D of the assembly guide 55A is near the operable portion 44. A substantially L-shaped first edge 55E is defined by an edge of the assembly guide 55A at the one widthwise side and the front edge of the slide permitting portion 55B, and a substantially L-shaped second edge 55F is defined by an edge of the assembly guide 55A at the other widthwise side and the rear edge of the slide permitting portion 55B.

The cover 70 is made e.g. of synthetic resin and has cap-shape, as shown in FIGS. 6 to 9. The cover 70 is slidable laterally along the wire draw out end of the housing 10 in the sliding direction SD, which is substantially orthogonal to the connecting direction. More particularly, the cover 70 can be slid from a standby position SP before a sliding movement to a mount position MP after the sliding movement. One widthwise end of the cover 70 projects out at one widthwise side of the housing 10 at the standby position SP (see FIG. 2). However, the cover 70 is accommodated substantially entirely within the width of the housing 10 at the mount position MP (see FIG. 3).

The cover 70 has a long narrow restricting plate 71 facing the wire draw out end of the housing 10 while being spaced therefrom. Spaced apart front and rear plates 72 project from opposite edges of the restricting plate 71 and an end plate 73 is connected to the front and rear plates 72 and the restricting plate 71 at one widthwise side. The restricting plate 71 is substantially U-shaped in section and functions to specify a draw-out direction of the wires 200 toward one widthwise side and in a direction substantially orthogonal to the connecting direction. A substantially U-shaped wire draw-out opening 74 is defined by one widthwise end edge of the restricting plate 71 and edges of the side plates 72. The end plate 73 is curved forward and includes a substantially U-shaped escape opening 75 at the front end edge of the cover 70. An opening area of the escape opening 75 is smaller than that of the wire draw-out opening 74, but most of the end plate 73 is cut off by the escape opening 75. The coupling 41 passes at an outer side of the other widthwise end of the end plate 73 in the process of rotating the lever 40.

Left and right cover slides 76F, 76R project in the mating direction at opposite widthwise sides of each of the front and rear plates 72, and hence at opposite front and rear ends of the side plates 72 in the sliding direction SD of the cover 70. Thus, the cover slides 76F, 76R are arranged at four corners spaced apart on the edge of the cover 70 opposite the restricting plate 71. The respective cover slides 76F, 76R define rectangular plate-shaped legs 77. The right cover slides 76R are at the rear end in the sliding direction SD of the cover 70 and the left cover slides 76F are at the front end in the sliding direction SD of the cover 70.

The left cover slides 76F are connected to outer surfaces of the front and rear plates 72 via steps. A bottomed left slide groove 76G is formed by an L-shaped wall 76H on the inner surface of a leading end of each left cover slide 76F. The left slide groove 76G extends in the width direction and is open at the left end. The left housing slides 22F slidably fit into the left slide grooves 76G, and the back ends of the left slide grooves 76G define left stops 76H that contact the left cover slides 22F in the sliding direction SD.

The right cover slides 76R are substantially continuous with ribs 78 substantially extending in the height direction on the outer surfaces of the front and rear plates 72. A bottomed right slide groove 76S is formed in the inner surface of a leading end of each right cover slide 76R and extend in the width direction to open at the left end. Each right slide groove 76S is defined by a crank-shaped wall and includes the front end edge of the side plate 72. The right housing slides 22R fit slidably into the right slide grooves 76S, and the back ends of the right slide grooves 76S define right stops 76T that contact the right housing slides 22R in the sliding direction SD.

A resiliently deformable cover lock 79 projects the mating direction near the right end of each of the front and rear plate 72 and behind the right cover slide 76R in the sliding direction SD. A slit 80 extends between the cover lock 79 and the right cover slide 76R. The cover locks 79 and the cover slides 76F, 76R form the legs 77.

A lock projection 81 projects from the inner surface of each cover lock 79. The lock projection 81 includes first and second guide surfaces 81A and 81B. The first guide surface 81A is at the left side, which is a front surface in the sliding direction SD, and inclines out toward the rear with respect to the sliding direction SD. The second guide surface 81B is located at a front in the assembling direction onto the housing 10 and inclines out toward the rear with respect to the assembling direction. An angle of inclination of the second guide surface 81B is steeper than that of the first guide surface 81A.

Spaces 60 are defined between the edge of the cover 70 and the wire draw out end of the housing 10 with the cover 70 properly mounted on the housing 10 and the wires 200 are exposed to the spaces 60. In other words, the spaces 60 are arranged between the respective legs 77. Specifically, the space 60 at the right side (rear side in the sliding direction) defines an inner space of the wire draw-out opening 74, the space at the left side (front side in the sliding direction) defines an inner space of the escape opening 75, and the spaces 60A between the legs 77 adjacent in the width direction are narrow slits that are long in the width direction.

Figure 2:
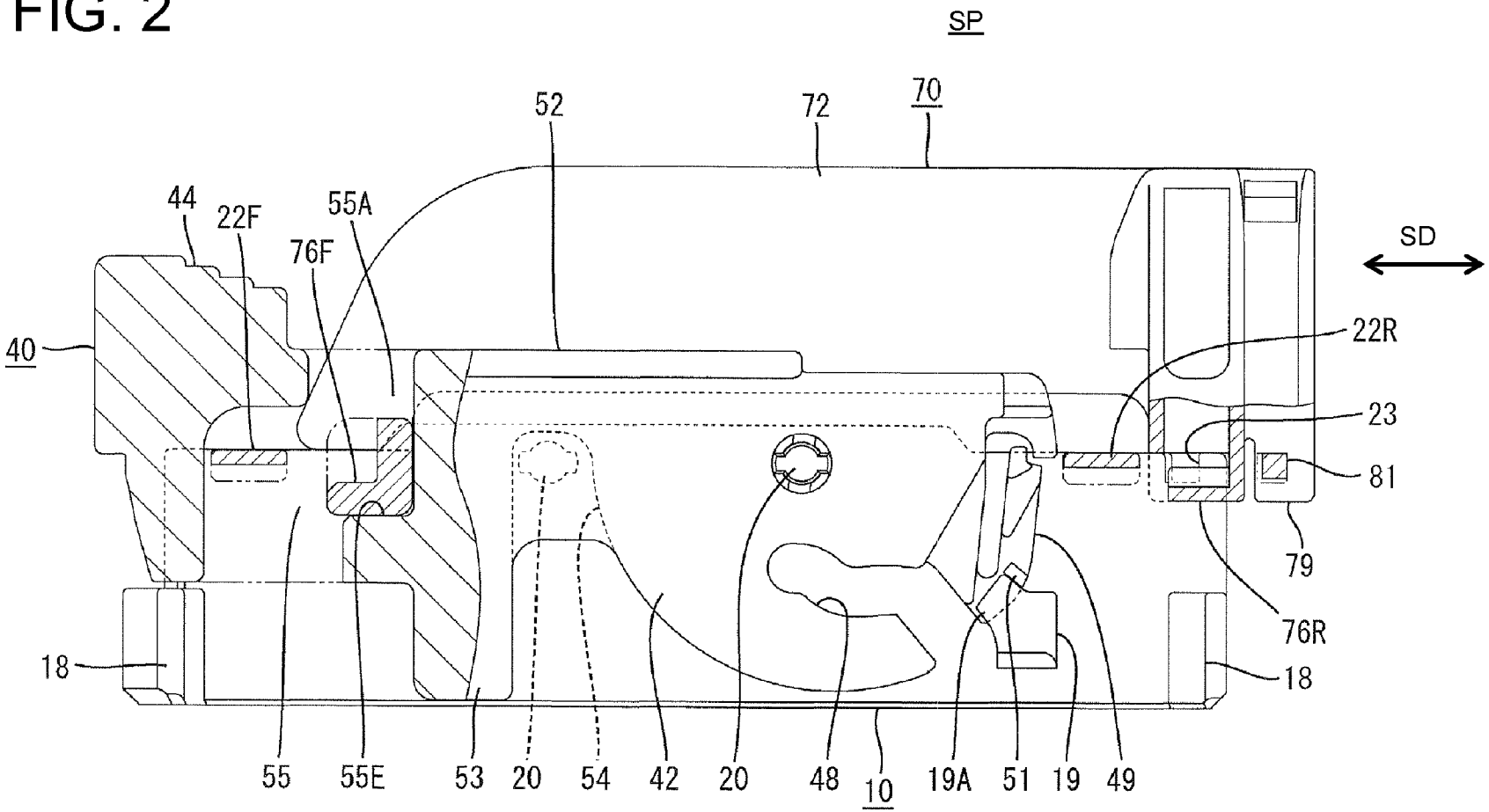
FIG. 2 is a plan view partly in section showing a state where the cover is mounted at a standby position.

The lever 40 is mounted on the housing 10 before the cover 70 is mounted and is left at the connection position CP. At this time, the second projections 51 of the resilient pieces 49 resiliently engage the hooking pieces 19A of the hooks 19 to prevent rotation of the lever 40 to the initial position IP and the front end edge of the coupling 41 contacts the protrusions 18 to prevent any further forward movement of the lever 40. The rear straight edges 52 of the arms 42 project slightly back from the wire draw out end of the housing 10 when the lever 40 is at the connection position CP and the entrances 55D of the assembly guides 55A of the guide paths 55 are open back at these straight edges 52, as shown in FIG. 1. In this state, the left cover slides 76F enter the entrances 55D of the assembly guides 55A and the cover 70 is displaced in the mating direction toward the standby position SP. In the inserting process, the left cover slides 76F fit loosely into the assembly guides 55A and slide along the second or first edges 55E, 55F of the assembly guides 55A to guide the assembling operation of the cover 70. The left cover slides 76F contact with the first edges 55E of the slide permitting portions 55B, as shown in FIG. 2, when the assembling is completed. Thus, any further displacement of the cover 70 in the mating direction is prevented and the cover 70 is stopped temporarily at the standby position SP.

The cover 70 then is moved substantially parallel with the wire draw out end of the housing 10 in the assembling process and displaces the left cover slides 76F. Alternatively, the left cover slides 76F may be held in contact with corners of the first edges 55E while the right side of the cover 70 is lifted from the housing 10, and the cover 70 then may be rotated about the contact position to bring the right side toward the housing 10. Further, in the assembling process, the second guide surfaces 81B of the lock projections 81 slide in contact with the wires 200 drawn out from the wire draw out end of the housing 10 in the assembling direction. Thus, resistance between the lock projections 81 and the wires 200 is reduced to ensure a smooth assembling operation of the cover 70.

At the standby position SP, the respective cover slides 76F, 76R are arranged at right sides of the corresponding housing slides 22F, 22R and the lock projections 81 of the respective cover locks 79 are arranged at the right of the corresponding housing locks 23. Further, at the standby position SP, the left housing slides 22F and the left cover slides 76F are hidden and substantially invisibly inside the arms 42 of the lever 40, whereas the right housing slides 22R, the right cover slides 76R and the cover locks 79 are visible from the outside.

Furthermore, at the standby position SP, the wires 200 enter the escape opening 75 to be let out.

In the above state, the cover 70 is pushed left toward the mount position MP. Thus, the left cover slides 22F slide on the groove surfaces of the left slide grooves 76G of the left cover slides 76F and the right housing slides 22R slide on the groove surfaces of the right slide grooves 76S of the right cover slides 76R to guide the cover 70 to the mount position MP in a well-balanced manner. In this sliding process to the mount position MP, the wires 200 face the spaces 60, particularly the widthwise space s 60A, and therefore the wires 200 will not be caught between the end edge of the cover 70 and the wire draw out end of the housing 10. Further, in the sliding process, the left cover slides 76F enter the slide permitting portions 55B of the guide paths 55 to be let out.

Figure 3:
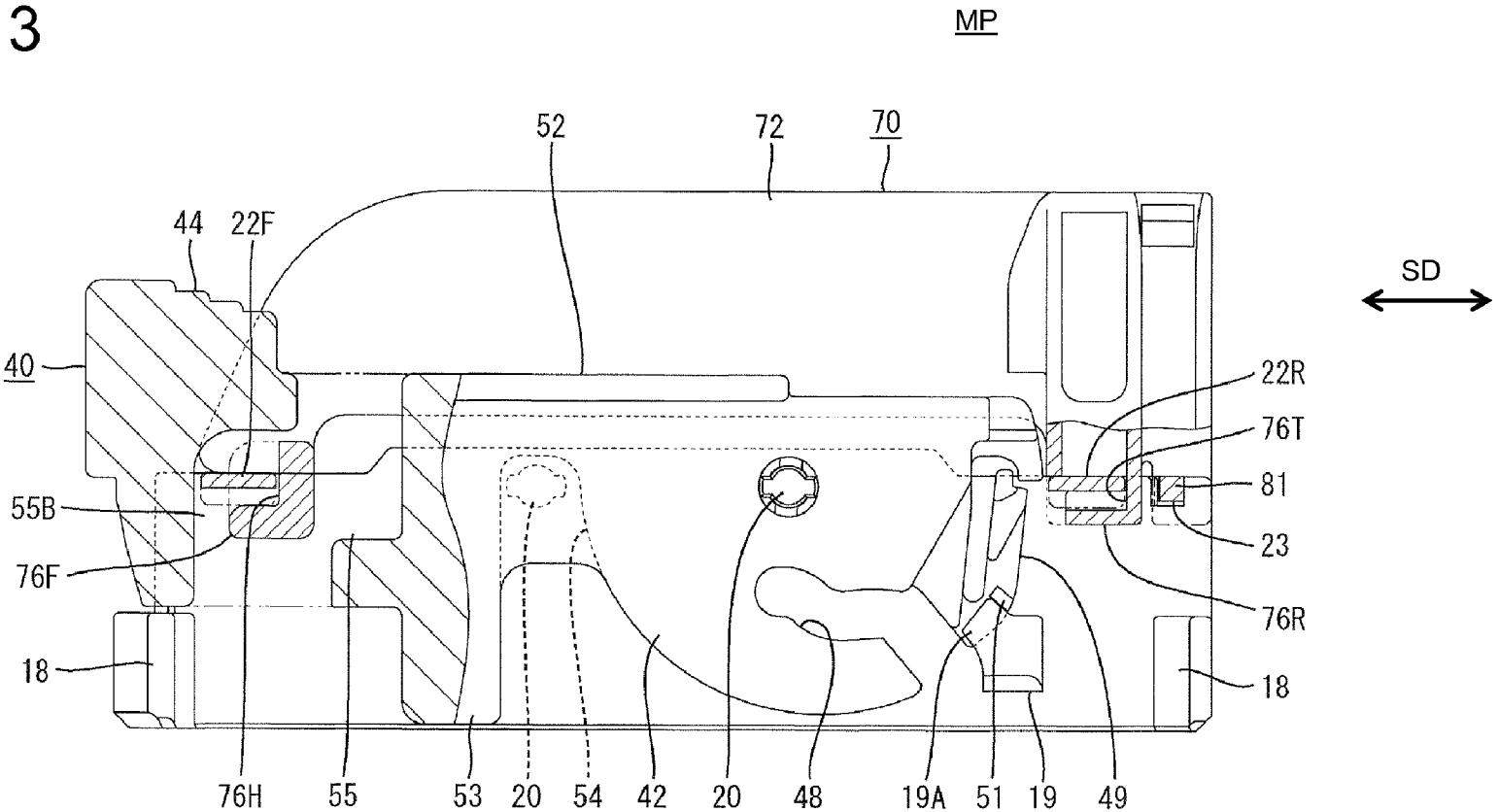
FIG. 3 is a plan view partly in section showing a state where the cover is mounted at a mount position.

The left cover slides 22F contact the left stops 76H of the left cover slides 76F and the right housing slides 22R contact the right stops 76T of the right housing slides 22R when the cover 70 reaches the mount position MP, as shown in FIG. 3, thereby preventing the cover 70 from being displaced any further. The lock projections 81 of the cover locks 79 fit resiliently into the housing locks 23 when the cover 70 reaches the mount position MP to prevent detachment of the cover 70 rearward from the sliding direction SD. Further, the right housing slides 22R are kept in the right cover slides 76R and the left housing slides 22F are kept in the left cover slides 76F to prevent loose movements of the cover 70 in the mating direction relative to the housing 10. The first guide surfaces 81A of the lock projections 81 slide on corners of the right side of the housing 10 in the mounting process of the cover 70 to the mount position MP thereby deforming the cover locks 79 outwardly. The cover locks 79 then resiliently restore as the lock projections 81 fit into the housing locks 23. At the mount position MP, the cover 70 and the housing 10 are connected only by the legs 77 and the remaining parts are open as the spaces 60.

Figure 4:
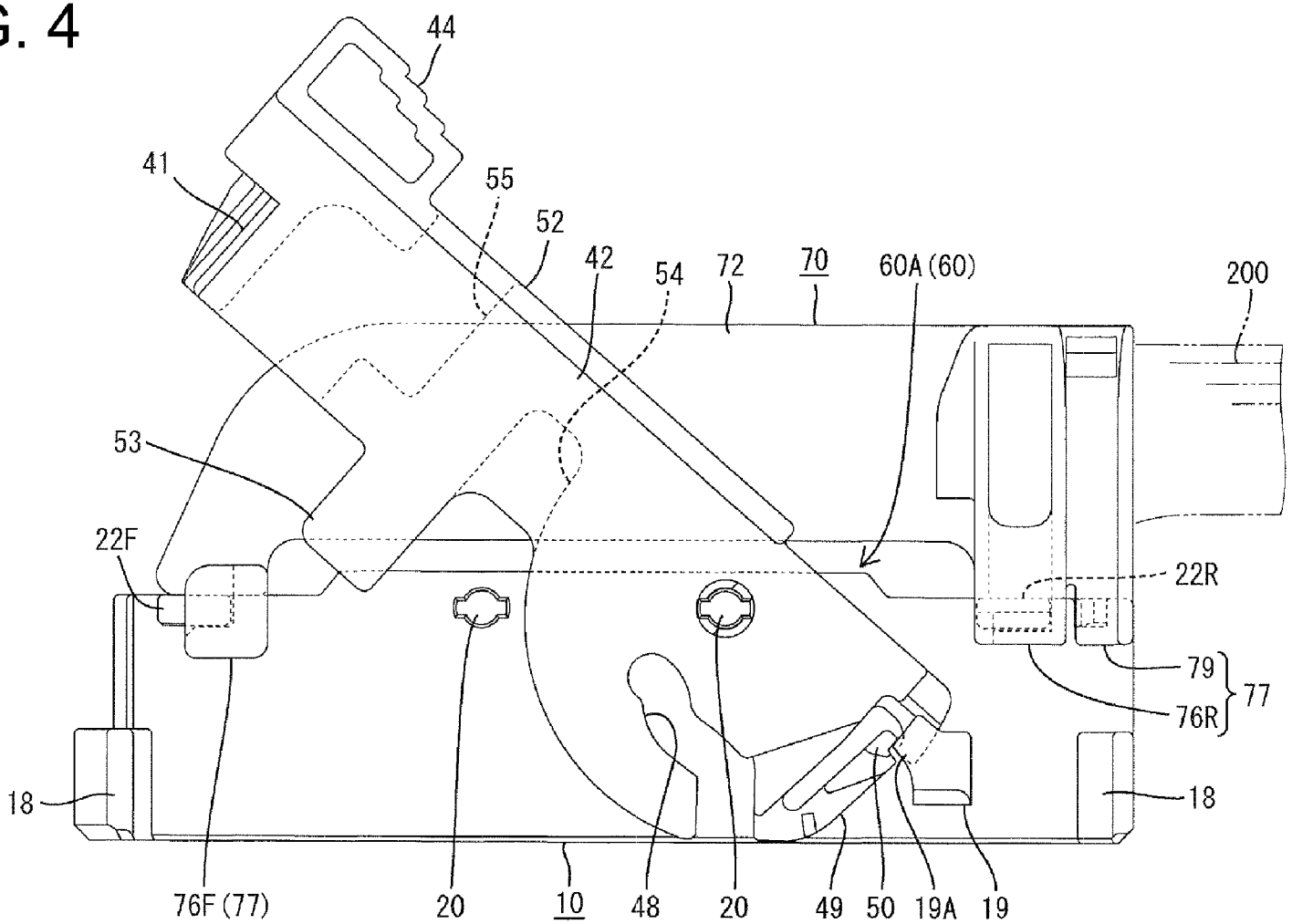
FIG. 4 is a plan view showing a state where a lever is at an initial position.

The lever 40 subsequently is displaced by gripping the coupling 41. At this time, the second projections 51 and the hooking pieces 19A merely are engaged lightly with each other and disengage easily. The first projections 50 of the resilient pieces 49 resiliently engage with the hooking pieces 19A when the lever 40 reaches the initial position IP, as shown in FIG. 4, to prevent a rotation of the lever 40 to the connection position CP. At the initial position IP, the entrances of the cam grooves 48 of the lever 40 are open forward. Further, at the initial position IP, corners of the leading ends of the projecting pieces 53 are located at outer sides of the bulges 21 of the housing 10. Thus, the wires 20 are accommodated inside the projections 53 and cannot project out. Additionally, the projections 53 cannot incline. Furthermore, the wires 200 can be seen through the spaces 60 at the initial position.

The housing 10 subsequently is fit lightly into the receptacle 110 of the mating housing 100. As a result, the cam followers 113 at the right side enter the cam grooves 48 and the first projections 50 and the hooks 19A are disengaged by the mating housing 100. In this state, the operable portion 44 is pushed forward to rotate the lever 40 toward the connection position CP. In the rotating process of the lever 40, the cam followers 113 slide along the groove surfaces of the cam grooves 48, and a cam action is displayed between the lever 40 and the mating housing 100 to connect the two housings 10, 100 with a low operation force. The lock 43 resiliently engages the engaging portion 112 when the lever 40 reaches the connection position CP, as shown in FIG. 5. Thus, the lever 40 is held on the mating housing 100 and cannot be rotated. Accordingly, the housing 10 is held in a connected state. At the connection position CP, the male tabs are connected electrically conductively to the corresponding female terminal fittings at proper depths through the tab insertion holes 15. Further, the widthwise spaces 60A are closed by the rear ends of the arms 42 at the connection position CP and it becomes practically impossible to see the wires 20 through the spaces 60A. Furthermore, at the connection position CP, the shafts 20 at the left side that are not supporting the lever 40 are in the recesses 54 of the arms 42 and the cam followers 113 at the left side that are not inserted into the cam grooves 48 are in constricted parts between the projections 53 and the action portions 45 to avoid interference of the shafts 20 and the cam followers 113 with the lever 40.

The connector of this embodiment can display the following effects.

The cover 70 is positioned and guided by the guiding portion and is set to the standby position SP without problem before starting the sliding movement of the cover 70. Thus, the cover 70 can be assembled smoothly.

The left cover slides 76F are guided while sliding along the guide paths 55 to provide functions of assembling and guiding the cover 70. Thus, the construction of the cover 70 is simplified.

The assembling direction of the cover 70 guided by the assembly guiding portions 55A of the guide paths 55 and the sliding direction of the cover 70 from the standby position SP to the mount position MP are substantially orthogonal to each other. Thus, the cover 70 is not brought to the mount position MP at once and the wires 200 are prevented from being caught between the cover 70 and the connector member.

The guide paths 55 are formed in the lever 40. Thus, a degree of freedom in the construction of the housing 10 is increased.

The guide paths 55 are formed by recessing the inner surfaces of the arms 42 of the lever 40 and the left cover slides 76F of the cover 70 are guided while sliding along the guide paths 55. Thus, the cover 70 can be guided in a well-balanced manner.

When the lever 40 is at the connection position CP, the rear edges of the arms 42 project from the rear end of the housing 10 and the entrances 55D of the assembly guides 55A of the both guide paths 55 are open at the rear edges of the arms 42. Thus, the cover 70 is positioned and guided at an initial stage before the cover 70 is engaged with the housing 10 to improve a guiding function even further.

The left cover slides 76F are hidden inside the lever 40 when the lever 40 is at the connection position CP. Thus, it is difficult to confirm visually whether the cover 70 has reached the standby position SP or the mount position MP and how far the cover 70 has been slid toward the mount position MP if the second slides are composed only of the left cover slides 76F. However, the right slides are visible from the outside of the cover 40 when the lever 40 is at the connection position CP. Thus, a current position of the cover 70 can be detected by visually confirming a positional relationship or the like of the cover slides 76R and right housing slides 22R.

The spaces 60 are between the legs 77 expose the wires 200 drawn out from the rear end of the housing 10 with the cover 70 mounted on the housing 10. Thus, the wires 200 cannot be caught between the cover 70 and the housing 10.

The legs 77 are on the cover 70 to simplify the construction of the housing 10.

The legs 77 include the cover slides 76F, 76R. Thus, the construction is simpler than a case where the cover slides 76F, 76R and the legs 77 are formed separately.

The arms 42 at least partly cover the widthwise spaces 60A at the connection position CP where the coupling 41 of the lever 40 is proximate to the housing 10 to impede entry of foreign matter into the spaces 60A.

The invention is not limited to the above described and illustrated embodiment. For example, the following embodiments also are included in the scope of the invention.

The guide paths may be formed in the housing. In this case, the lever may not be mounted on the housing.

The assembling direction of the cover and the sliding direction of the cover from the standby position to the mount position may cross without being orthogonal.

The slide permitting portion and the mold removing portion may be omitted from the guide path.

It is sufficient for the cover to include at least the restricting plate.

The respective leg pieces may be formed on the housing.

The rotating direction of the lever may be reversed.

What is claimed is:

1. A connector, comprising:

a connector member from which one or more wires are to be drawn out, the connector member being formed with at least one first slide, at least one first lock and at least one guide path; and a cover formed with at least one second slide slidably engaged with the at least one first slide for guiding a sliding movement of the cover between a standby position on the connector member and a mount position on the connector member where the cover at least partly covers the wires, the cover further having at least one second lock, the cover engaging the first lock at the mount position (MP) to prevent a returning movement of the cover to the standby position, and the cover cooperating with the at least one guide path for positioning and guiding the cover to the standby position, wherein an assembling direction of the cover guided by the guide path and a sliding direction of the cover from the standby position to the mount position cross each other.

2. The connector of claim 1, wherein the second slide is slidably guided substantially along the guide path.

3. The connector of claim 1, wherein the guide path comprises:

an assembly guiding portion arranged at a position near the coupling portion and substantially extending straight forward from the rear end edge of a linking portion of the arm portion, a slide permitting portion substantially extending from the front end of the assembly guiding portion toward the front side in the sliding direction of the restricting member and a mold removing portion substantially extending forward from an end of the slide permitting portion at the other widthwise side to the front end edge of the linking portion, wherein the assembly guiding portion and the mold removing portion preferably are positioned to at least partly overlap each other in the width direction.

4. The connector of claim 1, wherein the connector member includes a housing, from which the one or more wires are to be drawn out, and a movable member displaceably mounted on the housing for connecting the housing with a mating housing by a displacement thereof.

5. The connector of claim 4, wherein the guide path is formed on the movable member.

6. The connector of claim 5, wherein:

the at least one first slide comprises two first slides and the at least one first lock comprises two first locks formed on substantially opposite side surfaces of the housing;

the at least one second slide comprising two second slides and the at least one second lock comprising two second locks formed on substantially opposite side walls of the cover; and the movable member being substantially U-shaped and including a coupling and two arms projecting from the coupling, the arms substantially facing the opposite side surfaces of the housing.

7. The connector of claim 6, wherein the at least one guide path comprises two guide paths defined by recesses in inner surfaces of each of the arms, and the second slides being slidably guided substantially along the guide paths.

8. The connector of claim 7, wherein the second slides are slidably guided substantially along the guide paths at a connection position where the arms are most retracted toward the housing, end edges of the arms projecting from an end edge of the housing at the connection position, and entrances of the guide paths being open at the end edges of the arms.

9. The connector of claim 6, wherein the second slides are at each of front and rear sides of the cover separated in a sliding direction, the second slide at the front side in the sliding direction being slidably guided along the guide path and being hidden at an inner side of the movable member, the second slide at the rear side in the sliding direction being visible at an outer side of the movable member at the connection position.

10. A connector, comprising:

a housing with a mating end and a wire draw out end opposite the mating end, the housing further having opposite front and rear surfaces and opposite left and right side surfaces, left and right housing slides formed at positions on each of the front and rear surfaces in proximity respectively to the left and right side surfaces and in proximity to the wire draw out end the housing, the housing further having at least one housing lock;

a lever mounted rotatably on the housing and configured for assisting connection of the housing with a mating housing, the lever being formed with at least one guide path; and a cover with front and rear plates, left and right cover slides formed on each of the front and rear plates, the left and right cover slides slidably engaging the respective left and right housing slides for guiding a sliding movement of the cover between a standby position and a mount position on the housing where the cover at least partly covers the wire draw out end of the housing, the cover further having at least one cover lock engaging the housing lock when the cover is at the mount position to prevent a returning movement of the cover to the standby position, and the cover cooperating with the at least one guide path for positioning and guiding the cover to the standby position.

11. The connector of claim 10, wherein the left cover slides are guided slidably guided along the guide path.

12. The connector of claim 10, wherein an assembling direction of the cover guided by the guide path and a sliding direction of the cover from the standby position to the mount position cross each other.

13. The connector of claim 10, wherein the lever being substantially U-shaped and includes a coupling and two arms projecting from the coupling, the arms substantially facing the opposite front and rear surfaces of the housing.

14. The connector of claim 13, wherein the at least one guide path comprises two guide paths defined by recesses in inner surfaces of each of the arms, and the cover slides being slidably guided substantially along the guide paths.

15. A connector, comprising:

a connector member including a housing from which one or more wires are to be drawn out, the housing being formed with at least one first slide and at least one first lock, the connector member further including a movable member displaceably mounted on the housing for connecting the housing with a mating housing by a displacement thereof, at least one guide path formed on the movable member; and a cover formed with at least one second slide slidably engaged with the at least one first slide for guiding a sliding movement of the cover between a standby position on the connector member and a mount position on the connector member where the cover at least partly covers the wires, the cover further having at least one second lock, the cover engaging the first lock at the mount position to prevent a returning movement of the cover to the standby position, and the cover cooperating with the at least one guide path for positioning and guiding the cover to the standby position.

16. The connector of claim 15, wherein:

the at least one first slide comprises two first slides and the at least one first lock comprises two first locks formed on substantially opposite side surfaces of the housing;

the at least one second slide comprising two second slides and the at least one second lock comprising two second locks formed on substantially opposite side walls of the cover; and the movable member being substantially U-shaped and including a coupling and two arms projecting from the coupling, the arms substantially facing the opposite side surfaces of the housing.

17. The connector of claim 16, wherein the at least one guide path comprises two guide paths defined by recesses in inner surfaces of each of the arms, and the second slides being slidably guided substantially along the guide paths.

18. The connector of claim 17, wherein the second slides are slidably guided substantially along the guide paths at a connection position where the arms are most retracted toward the housing, end edges of the arms projecting from an end edge of the housing at the connection position, and entrances of the guide paths being open at the end edges of the arms.

19. The connector of claim 16, wherein the second slides are at each of front and rear sides of the cover separated in a sliding direction, the second slide at the front side in the sliding direction being slidably guided along the guide path and being hidden at an inner side of the movable member, the second slide at the rear side in the sliding direction being visible at an outer side of the movable member at the connection position.

20. The connector of claim 15, wherein the guide path comprises:

an assembly guiding portion arranged at a position near the coupling portion and substantially extending straight forward from the rear end edge of a linking portion of the arm portion, a slide permitting portion substantially extending from the front end of the assembly guiding portion toward the front side in the sliding direction of the restricting member and a mold removing portion substantially extending forward from an end of the slide permitting portion at the other widthwise side to the front end edge of the linking portion, wherein the assembly guiding portion and the mold removing portion preferably are positioned to at least partly overlap each other in the width direction.

* * * * *